US007700894B2

(12) United States Patent
Quella

(10) Patent No.: US 7,700,894 B2
(45) Date of Patent: Apr. 20, 2010

(54) HEATED FOOD DISPLAY

(75) Inventor: John F. Quella, Sturgeon Bay, WI (US)

(73) Assignee: Hatco Corporation, Milwaukee, WI (US)

( * ) Notice: Subject to any disclaimer, the term of this patent is extended or adjusted under 35 U.S.C. 154(b) by 479 days.

(21) Appl. No.: 11/539,294

(22) Filed: Oct. 6, 2006

(65) Prior Publication Data

US 2008/0083722 A1 Apr. 10, 2008

(51) Int. Cl.
*H05B 1/00* (2006.01)
*A47F 3/00* (2006.01)

(52) U.S. Cl. ..... 219/214; 219/400; 312/138.1; 312/128; 312/236; 99/468; 99/476; 99/483; 126/21 A; 165/918; 62/252; 62/255

(58) Field of Classification Search ..... 219/214, 219/400; 312/114, 138.1, 128, 236; 99/468, 99/476, 483; 126/21 A; 165/918; 62/252, 62/255

See application file for complete search history.

(56) References Cited

U.S. PATENT DOCUMENTS

| | | | | |
|---|---|---|---|---|
| 3,648,010 | A | 3/1972 | Schier | |
| 3,887,786 | A | 6/1975 | Witt et al. | |
| 3,911,248 | A | 10/1975 | Buday et al. | |
| 4,074,108 | A | 2/1978 | King | |
| 4,343,985 | A | 8/1982 | Wilson et al. | |
| 4,990,749 | A | 2/1991 | Devine et al. | |
| 5,203,255 | A | 4/1993 | Wells et al. | |
| 5,553,934 | A * | 9/1996 | Wells et al. | 312/128 |
| 6,011,243 | A | 1/2000 | Arnold et al. | |
| 6,098,529 | A | 8/2000 | Brummett et al. | |
| 6,259,065 | B1 | 7/2001 | Hohler et al. | |
| 6,412,403 | B1 | 7/2002 | Veltrop | |
| 6,455,816 | B1 | 9/2002 | Reddy et al. | |
| 6,603,098 | B2 | 8/2003 | Reddy et al. | |
| 6,627,855 | B2 | 9/2003 | Hohler et al. | |
| 6,642,487 | B2 | 11/2003 | Stanzel | |
| 6,658,994 | B1 | 12/2003 | McMillan | |
| 6,707,008 | B2 | 3/2004 | Roehr et al. | |

* cited by examiner

*Primary Examiner*—Shawntina Fuqua
(74) *Attorney, Agent, or Firm*—Michael Best & Friedrich LLP

(57) ABSTRACT

A food display including a container for holding a product and having at least one translucent portion that facilitates viewing the product from outside the container, a sign panel that is coupled to the container and is at least partially translucent, and a light assembly that includes a light source positioned to provide light to both the container and the sign panel. Preferably, the sign panel and the light source are both positioned above an upper plane of the container to facilitate backlighting the sign panel. The food display may further include a fan positioned above the upper plane of the container, and an air circulation system that circulates air within the container. In one embodiment, the container includes a conduit, such as a hollow corner post that supports a side panel of the container, extending from the upper portion to the lower portion.

15 Claims, 4 Drawing Sheets

HEATED FOOD DISPLAY

BACKGROUND OF THE INVENTION

The present invention relates to food displays that are heated so that warm food products can be displayed to the consumer prior to purchase.

Heated food displays typically include a container having transparent side walls that facilitate viewing the food product by the consumer. The container can be opened to facilitate insertion and removal of the food product. Such displays also commonly include a light for illuminating the food product, a heater for heating the air in the container, and a fan for circulating the heated air. These electrical components are typically positioned above the container and are covered by a hood for aesthetic reasons.

Heated food displays can also include signage that indicated the type of product being offered for sale. For example, such signage is commonly positioned on the hood above the container.

Some heated food displays also include an air circulation system for circulating air in the container. Such systems commonly include a fan mounted above the container, and including inlet and outlet ports in the ceiling.

SUMMARY OF THE INVENTION

The present invention provides a food display that efficiently uses a single light source for both illuminating the food product and illuminating the signage. The food display comprises a container for holding a product and having at least one translucent portion that facilitates viewing the product from outside the container, a sign panel coupled to the container and being at least partially translucent, and a light assembly including a light source positioned to provide light to both the container and the sign panel. Preferably, the sign panel and the light course are both positioned above an upper plane of the container to facilitate backlighting the sign panel. In one embodiment, the display further includes a fan positioned above and defining a gap between the fan and the upper plane of the container, and the light source is positioned in the gap and is generally horizontally aligned with the sign panel.

The present invention also provides a food display having an air circulation system that efficiently circulates air within the container. The food display comprises a container for holding a product, a fan coupled to the container, and a circulation system for circulating gas provided by the fan. The circulation system includes a gas inlet port and a gas outlet port. One of the ports is positioned adjacent the upper portion of the container and the other of the ports is positioned adjacent the lower portion of the container. In one embodiment, the container includes a conduit, such as a hollow corner post that supports a side panel of the container, extending from the upper portion to the lower portion. The corner post preferably includes a lower opening that acts as one of the ports. Also, the container preferably includes multiple corner posts that each act as a conduit to distribute the effective area of the inlet or exhaust port.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

The illustrated heated food display 10 is designed to support and display a food product, such as pizza or pretzels, in a heated environment. The display 10 includes a container 12 and an upper assembly 14 positioned on top of the container 12 and containing various electrical components.

Figure 4:
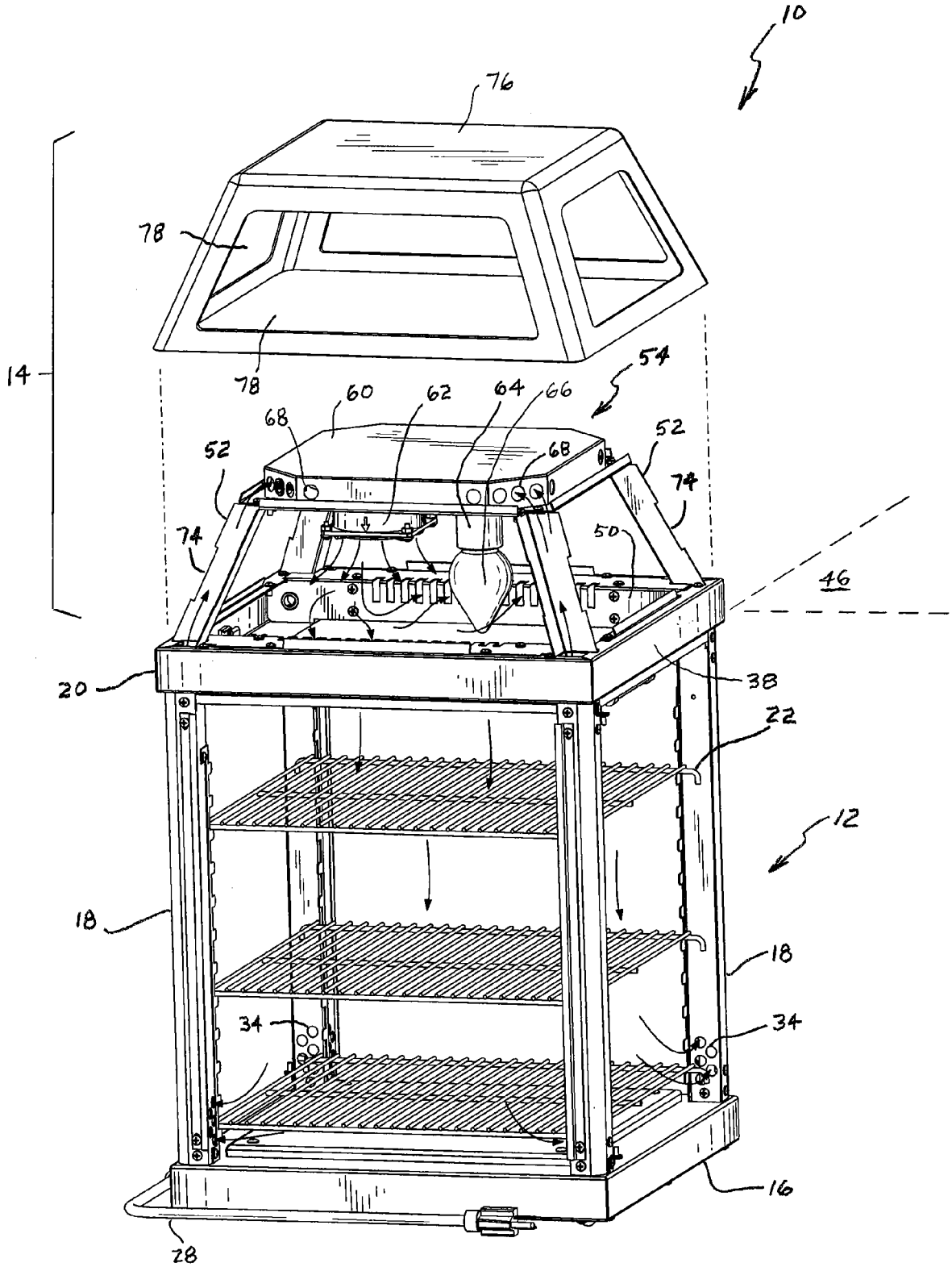
FIG. 4 is a perspective view of the heated food display of FIG. 1 with a hood removed.

The illustrated container 12 includes a square base 16, four corner posts 18 extending upwardly from the corners of the base 16, a ceiling 20 secured to the upper ends 36 of the corner posts 18, and a rack assembly 22. Translucent (e.g., glass or polycarbonate) side panels 24 are positioned in the openings defined by the base 16, corner posts 18, and ceiling 20. In the illustrated embodiment, one of the side panels 24 is hinged to a corner post to form a door 26 having a handle, so that the interior of the container 12 can be accessed. Note that the side panels 24 are omitted from FIG. 4 for clarity.

The base 16 includes a power cord 28 that can be plugged into an electrical outlet to provide power to the display 10. In addition, the base 16 includes a power switch 30 to turn the display 10 on or off, and a thermostat 32 to control the temperature inside the container 12. The power is wired to the upper assembly 14 via the corner posts 18, although wiring is not shown in the drawings.

Figure 1:
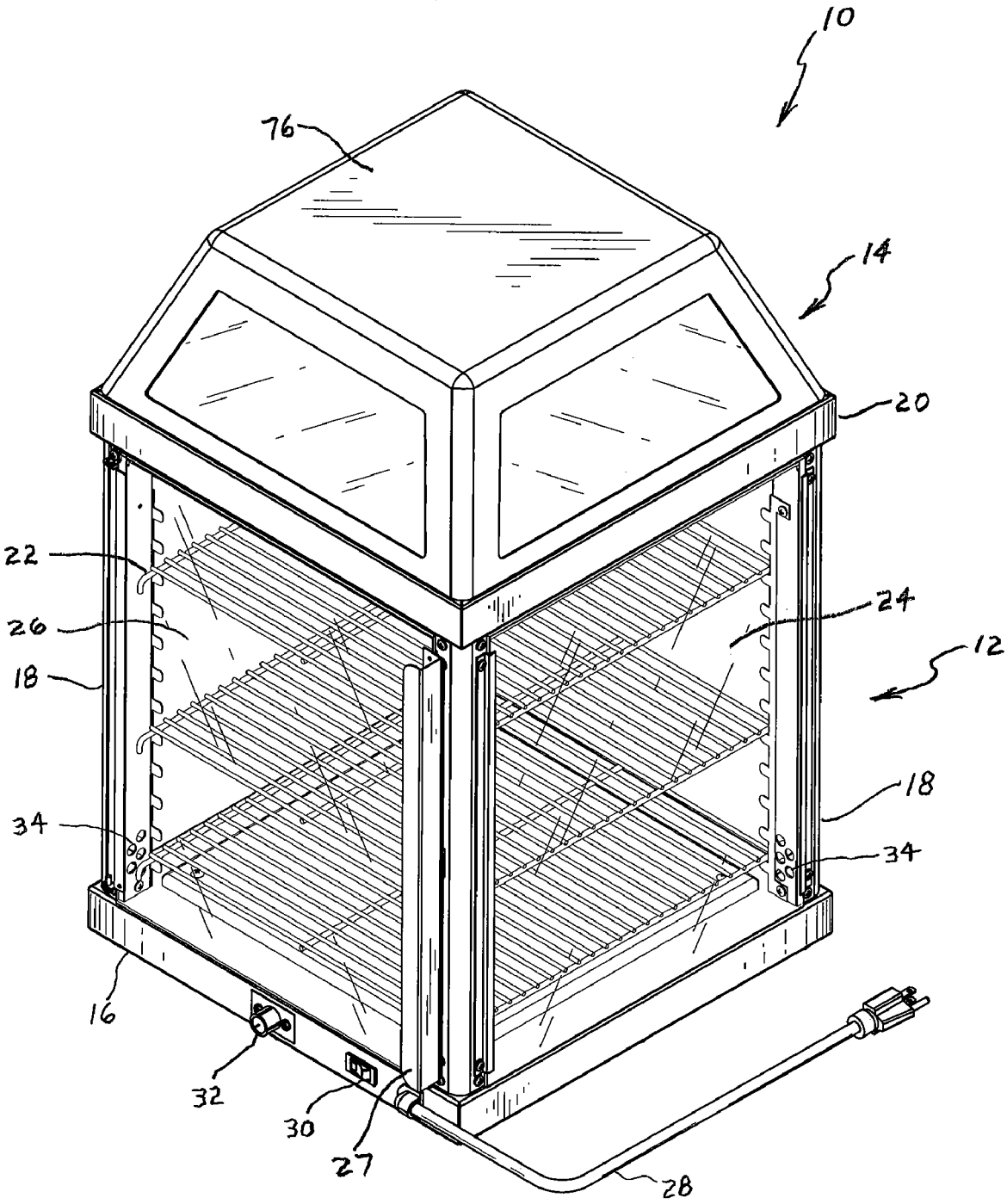
FIG. 1 is a perspective view of a heated food display embodying the present invention.
Figure 2:
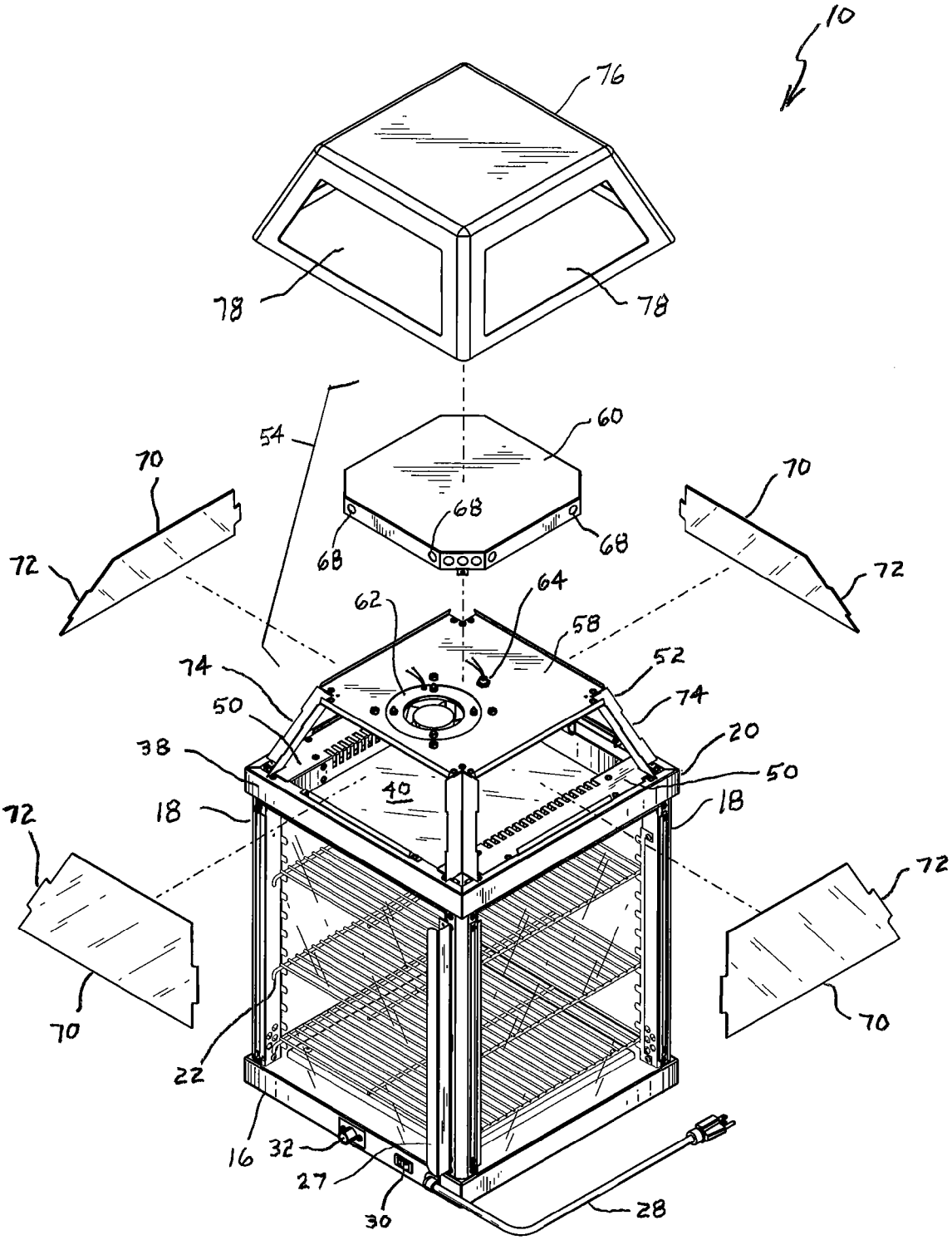
FIG. 2 is a partially-exploded, perspective view of the heated food display of FIG. 1.
Figure 3:
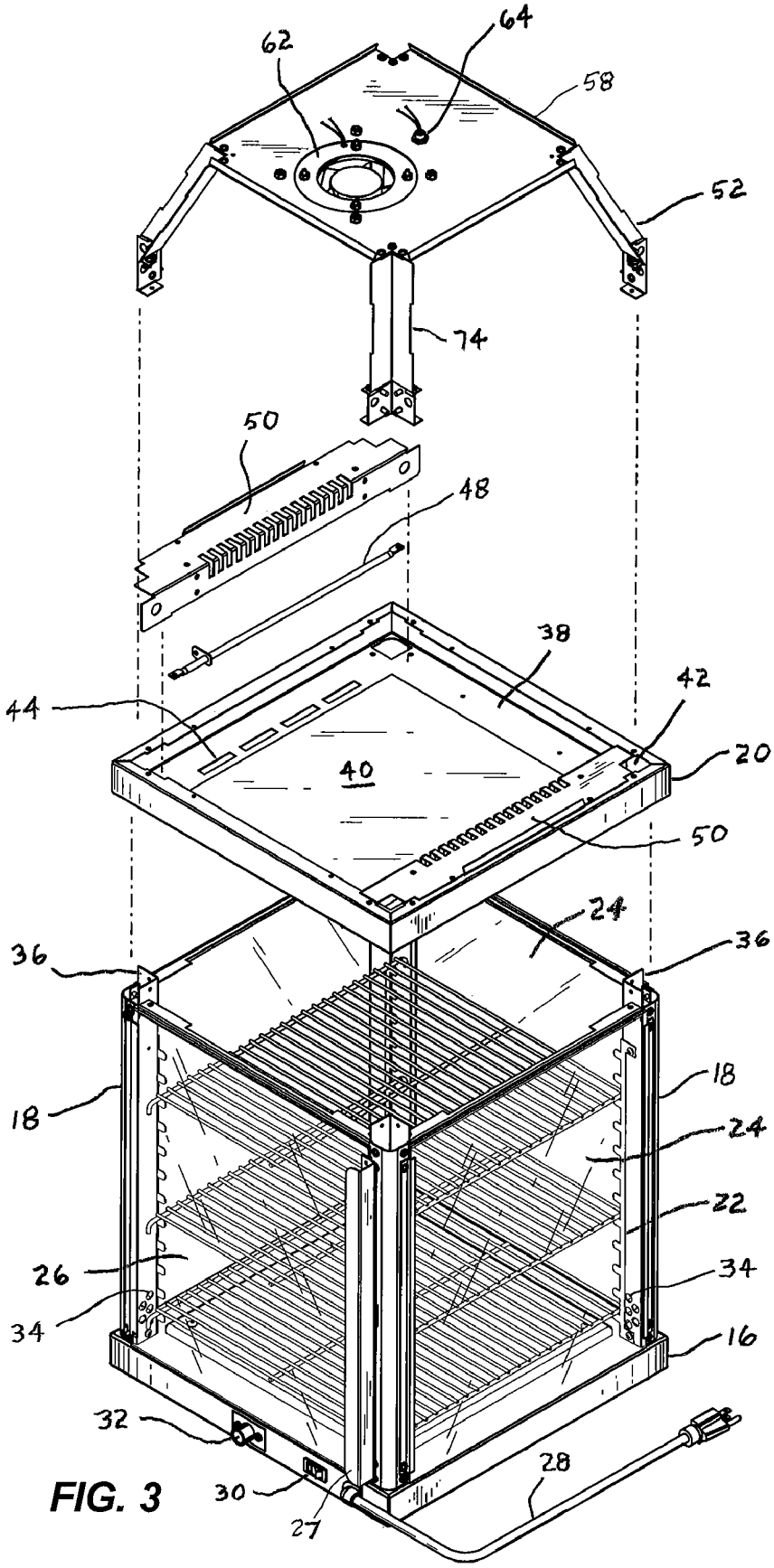
FIG. 3 is another partially-exploded, perspective view of the heated food display of FIG. 1.

As best shown in FIG. 3, the corner posts 18 are each hollow members having a generally square cross section. The lower end of each corner post 18 includes outlet ports in the form of ten lower holes 34 open to the interior of the container 12 and facilitating circulation of air out of the container 12 and through the corner posts 18, as described below in more detail. The upper end 36 of the each corner post is open to facilitate circulatory communication with the upper assembly 14, as described below in more detail.

The ceiling 20 includes a frame 38 and a translucent (e.g., glass of polycarbonate) top panel 40 positioned in the center of the frame 38. The frame 38 includes an opening 42 (FIG. 3) in each corner in alignment with and receiving at least a portion of each of the upper ends 36 of the corner posts 18. The ceiling 20 also includes inlet ports in the form of four slots 44 (FIG. 3) along each of two opposing sides. The slots 44 provide for the flow of air from above the ceiling 20 to below the ceiling 20. The top panel 40 generally defines an upper plane 46 (FIG. 4) of the container 12.

The display 10 also includes heating elements 48 positioned along opposing sides of the ceiling 20, above the slots 44. The heating elements 48 provide heat to the air passing through the slots 44 to maintain the food product at a desired temperature. Element guards 50 are provided to visually and physically separate the heating elements 48 from the surrounding environment.

The upper assembly 14 includes four ceiling corners 52 mounted to the corners of the ceiling 20. Each ceiling corner comprises a two-sided angle member that is secured adjacent to a corresponding opening 42 in a corner post to define a portion of the conduit for guiding air upward. At least one ceiling corner 52 also provides a conduit for routing electrical wiring from the base 16 to the upper assembly 14.

The upper assembly 14 further includes a fan and lamp assembly 54 secured to the tops of the ceiling corners 52. The fan 62 and lamp assembly 54 includes a fan box defined by a base 58 and a cover 60 secured over the top of the base 58. A fan 62 and a lamp holder 64 are each suspended from the bottom of the base 58 and above the upper plane 46 of the container 12. A lamp bulb 66 is mounted in the lamp holder 64 and generally above the upper plane 46 of the container 12. The cover 60 includes five corner holes 68 in each corner to facilitate air being drawn from the ceiling corners 52 and into the fan box. The fan 62 then forces the air out of the fan box and into the space above the ceiling 20.

Sign panels 70 are positioned on all four sides of the upper assembly 14 between the ceiling corners 52 and above the upper plane 46 of the container 12. Each sign panel includes two opposing tabs 72 that are designed to fit in corresponding notches 74 in the ceiling corners 52. The sign panels 70 are translucent, and are designed to have images and/or text that correspond with the food product being displayed. Because the sign panels 70 are positioned below the fan and lamp assembly 54 and above the upper plane 46 of the container 12, they are generally horizontally aligned with the lamp bulb 66 so that the sign panels 70 are back lit. Note that the sign panels 70 are omitted from FIG. 4 for clarity.

A hood 76 provides an aesthetic cover over the top of the fan and lamp assembly 54 and the ceiling corners 52. The hood 76 also acts to enclose the ceiling corners 52 to complete the air-guiding conduit through the ceiling corners 52. The hood 76 includes sign openings 78 that align with the sign panels 70 to facilitate viewing the sign panels 70 when the hood 76 is installed.

There are a variety of materials that can be used to produce the illustrated heated food display 10. For example, the base, corner posts, ceiling, rack assembly, door handle, and hood are preferably stainless steel. The side panels and top panel are preferably clear polyethylene or tempered glass. The sign panels are preferably polyethylene with translucent tinting or coating to establish the desired background for the image or text to be printed in the surface. The ceiling corners, fan box, and element guards are also preferably stainless steel. Other materials for these parts, such as food grade plastics, could be used without departing from the spirit of the present invention.

By virtue of the above-described heated food display 10, light from the bulb 66 is used to both illuminate the food product (through the top panel 40 of the ceiling 20) and illuminate the sign panels 70. There is no need for separate lighting sources for those two functions.

In addition, the above-described heated food display 10 provides an efficient air circulation system. Air from the fan 62 is expelled into the space above the ceiling 20 and is forced past the heating elements 48, where the air is heated. The air them passes through the slots 44 in the ceiling 20 and into the container 12. Air is recirculated back to the fan 62 through the lower holes 34, through the corner posts 18, through the ceiling corners 52, through the corner holes 68 and into the fan box. By virtue of this arrangement, circulation occurs by drawing air from four different zones in the bottom of the container 12, and expelling air at multiple locations on opposing sides of the top of the container 12, thus improving circulation and reducing the likelihood of dead zones.

What is claimed is:

1. A food display comprising:

a container for holding a product and having at least one translucent portion that facilitates viewing the product from outside the container, the container defining an upper plane;

a fan positioned above the upper plane and defining a gap between the fan and the upper plane;

a sign panel coupled to the container and being at least partially translucent; and a light assembly including a light source positioned in the gap to provide light to both the container and the sign panel.

2. The food display of claim 1, wherein the container includes a door for accessing the interior of the container.

3. The food display of claim 2, wherein the door includes a translucent portion that facilitates viewing the product through the door.

4. The food display of claim 1, wherein the container includes multiple translucent portions that facilitate viewing the product from outside the container.

5. The food display of claim 1, wherein the container defines an upper plane, and the sign panel is positioned above the upper plane.

6. The food display of claim 1, wherein the container defines an upper plane, and the light source is positioned above the upper plane.

7. The food display of claim 1, wherein the light source is generally horizontally aligned with the sign panel.

8. The food display of claim 1 further comprising:

a fan coupled to the container; and a circulation system for circulating gas provided by the fan, the circulation system including a gas inlet port and a gas outlet port, one of the ports being positioned adjacent an upper portion of the container and the other of the ports being positioned adjacent a lower portion of the container.

9. The food display of claim 8, wherein the container includes a conduit extending from the upper portion to the lower portion.

10. The food display of claim 9, wherein the container includes a translucent side panel and a corner post that supports the side panel, wherein the corner post is hollow and acts as the conduit.

11. A food display comprising:

a container for holding a product and having at least one translucent portion that facilitates viewing the product from outside the container, the container including a translucent side panel and a hollow corner post supporting the side panel;

a conduit defined by the hollow corner post extending substantially from an upper portion of the container to a bottom portion of the container and including an air inlet and an air outlet, wherein one of the air inlet and the air outlet is positioned substantially adjacent the bottom portion, and the other of the air inlet and the air outlet is positioned substantially adjacent the upper portion, the air inlet and the air outlet being substantially spaced from one another along the conduit by a middle portion free of air inlets and outlets; and a fan coupled to the container and positioned such that the fan circulates air within the container through the conduit.

12. The food display of claim 11, further comprising a sign panel coupled to the container and being at least partially translucent; and a light assembly including a light source positioned to provide light to both the container and the sign panel.

13. The food display of claim 11, further comprising four corner posts that support the container, each of the four corner post is hollow and acts as a conduit.

14. The food display of claim 11, further comprising an upper assembly positioned above the container, the fan positioned in the upper assembly and the conduit in communication with the upper assembly.

15. The food display of claim 14, further comprising a heating element positioned in the upper assembly;

wherein the air inlet is positioned substantially adjacent the lower portion and the air outlet is positioned substantially adjacent the upper portion and in direct communication with the upper assembly; and wherein the fan blows air past the heating element to supply heated air to the container.

* * * * *